US009362666B2

(12) United States Patent
Laughlin

(10) Patent No.: US 9,362,666 B2
(45) Date of Patent: Jun. 7, 2016

(54) ANTI-DECOUPLING SPRING

(71) Applicant: Patrick John Laughlin, Thousand Oaks, CA (US)

(72) Inventor: Patrick John Laughlin, Thousand Oaks, CA (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 0 days.

(21) Appl. No.: 14/485,249

(22) Filed: Sep. 12, 2014

(65) Prior Publication Data

US 2016/0079702 A1 Mar. 17, 2016

(51) Int. Cl.
*H01R 4/38* (2006.01)
*H01R 13/629* (2006.01)

(52) U.S. Cl.
CPC ..... *H01R 13/629* (2013.01)

(58) Field of Classification Search
CPC ..... H01R 13/62933; H01R 13/623; H01R 13/622; H01R 13/625; H01R 13/5812; H01R 13/5804; H01R 13/595; E21B 17/043; F16L 37/252; F16L 19/005; F16L 25/065
USPC ..... 439/310–312, 317–321, 470–473; 285/81, 82, 89, 90, 92
See application file for complete search history.

(56) References Cited

U.S. PATENT DOCUMENTS 3,669,472 A * 6/1972 Nadsady ..... F16L 19/005 285/233
3,971,614 A * 7/1976 Paoli ..... H01R 13/621 285/85
4,030,798 A * 6/1977 Paoli ..... H01R 13/621 285/85
4,359,254 A * 11/1982 Gallusser ..... H01R 13/622 439/321
4,472,013 A * 9/1984 Frear ..... H01R 13/622 439/312
4,478,474 A * 10/1984 Gallusser ..... H01R 13/622 439/312
4,808,117 A * 2/1989 Gale ..... F16L 25/01 439/192
5,192,219 A 3/1993 Fowler et al.
5,199,894 A 4/1993 Kalny et al.
6,050,609 A * 4/2000 Boscaljon ..... F16L 19/005 285/354
6,123,563 A * 9/2000 Johnson ..... H01R 13/622 439/321
6,152,753 A 11/2000 Johnson et al.
7,003,351 B2 * 2/2006 Tvaska ..... A61N 1/375 439/909
7,587,244 B2 * 9/2009 Olbertz ..... A61N 1/3752 607/37
7,914,311 B1 3/2011 Gallusser et al.
8,062,063 B2 * 11/2011 Malloy ..... H01R 13/187 439/578
8,157,588 B1 * 4/2012 Rodrigues ..... H01R 13/622 439/578

* cited by examiner

*Primary Examiner* — Thanh Tam Le
(74) *Attorney, Agent, or Firm* — King & Spalding LLP

(57) ABSTRACT

A connector spring includes a ring and a plurality of protruding segments protruding radially out from the ring. Each protruding segment of the plurality of protruding segments includes a first spring finger extending out from the protruding segment and a second spring finger extending out from the protruding segment. The first spring finger and the second spring finger angularly extend away from each other on a first side of the ring. The connector spring further includes a plurality of dimples protruding out on a second side of the ring.

22 Claims, 5 Drawing Sheets

ANTI-DECOUPLING SPRING

TECHNICAL FIELD

The present disclosure relates generally to a connector spring, in particular to an anti-decoupling spring that functions as a system spring and a ratchet spring while incorporating dimples that serve as ratchet detents.

BACKGROUND

A connector, such as an electrical connector, may include a plug shell and a coupling ring rotatably coupled around the plug shell. The plug may be internally threaded and may be coupled to an externally threaded receptacle shell. For example, a coupling ring of an electrical connector may be rotated in a coupling direction around a receptacle shell such that electrical contacts in the receptacle shell mate with corresponding electrical contacts in the plug shell. Some connectors may include a retaining ring that retains the coupling ring rotatably attached on the plug shell. However, in some applications, the connector may be exposed to vibration and mechanical shock that may result in unintentional decoupling of the coupling ring from the receptacle shell.

To prevent the unintentional decoupling of the coupling ring by rotating in a decoupling direction, a ratchet spring that is attached to the inside of the coupling ring may be used. For example, ratchet teeth/detents on the outer circumference of the plug shell may engage the ratchet spring to resist decoupling of the coupling ring. Further, a system spring may be used to minimize axial motion of the plug shell once the plug shell is coupled to the receptacle shell by the coupling ring. The connector may also include a keying system involving one or more of the receptacle shell, the connector shell, and the plug shell.

Instead of having multiple individual components, combining the system spring, the ratchet spring, and the detents into a single component may be desirable to reduce component count and, thus, to reduce manufacturing cost.

SUMMARY

In general, the present disclosure relates to a connector spring that functions as a ratchet spring as well as a system spring. In an example embodiment, a connector spring includes a ring and a plurality of protruding segments protruding radially out from the ring. Each protruding segment of the plurality of protruding segments includes a first spring finger extending out from the protruding segment and a second spring finger extending out from the protruding segment. The first spring finger and the second spring finger angularly extend away from each other on a first side of the ring. The connector spring further includes a plurality of dimples protruding out on a second side of the ring.

In another example embodiment, an electrical connector includes a plug shell having an annular shoulder that includes plurality of depressions. The electrical connector further includes a coupling ring rotatably positioned around a portion of the plug shell. The electrical connector also includes a connector spring positioned around the plug shell between the plug shell and the coupling ring. The connector spring includes a ring and a plurality of protruding segments protruding radially out from the ring. Each protruding segment of the plurality of protruding segments includes a first spring finger extending out from a first edge of the protruding segment and a second spring finger extending out from a second edge of the protruding segment. The first spring finger and the second spring finger extend away from each other and from the annular shoulder. The connector spring further includes a plurality of dimples extending out at least partially from the plurality of protruding segments. Each dimple of the plurality of dimples is positioned in a respective depression of the plurality of depressions In another example embodiment, an electrical connector includes a receptacle shell, a plug shell, and a coupling ring positioned around a portion of the plug shell and around a portion of the receptacle shell. The electrical connector further includes a connector spring positioned around the plug shell surrounded by the coupling ring. The connector spring includes a ring and a plurality of protruding segments protruding radially out from the ring. Each protruding segment of the plurality of protruding segments includes a first spring finger extending out from a first edge of the protruding segment and a second spring finger extending out from a second edge of the protruding segment. The first spring finger and the second spring finger extend angularly away from each other. The connector spring further includes a plurality of dimples extending out at least partially from the plurality of protruding segments.

These and other aspects, objects, features, and embodiments will be apparent from the following description and the claims.

BRIEF DESCRIPTION OF THE DRAWINGS

Reference will now be made to the accompanying figures, which are not necessarily to scale, and wherein.

Figure 1A:
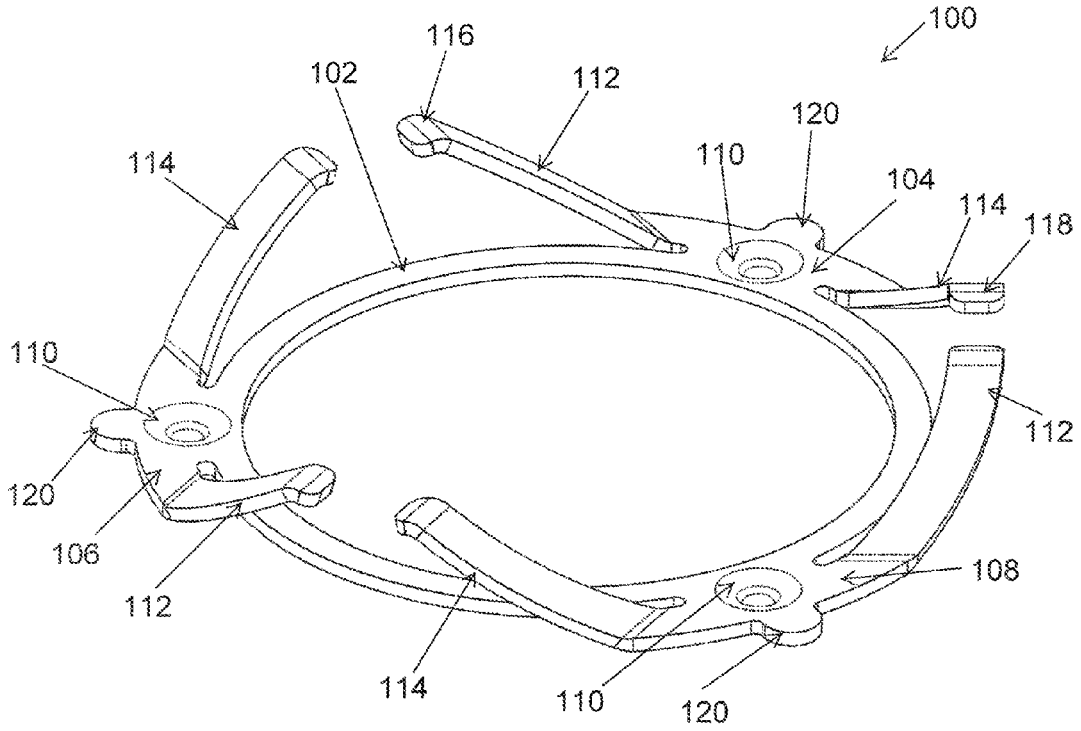
FIG. 1A illustrates a perspective view of a connector spring according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the figures, reference numerals designate like or corresponding, but not necessarily identical, elements.

DETAILED DESCRIPTION OF THE EXAMPLE EMBODIMENTS

In the following paragraphs, particular embodiments will be described in further detail by way of example with reference to the figures. In the description, well known components, methods, and/or processing techniques are omitted or briefly described. Furthermore, reference to various feature(s) of the embodiments is not to suggest that all embodiments must include the referenced feature(s).

Figure 1B:
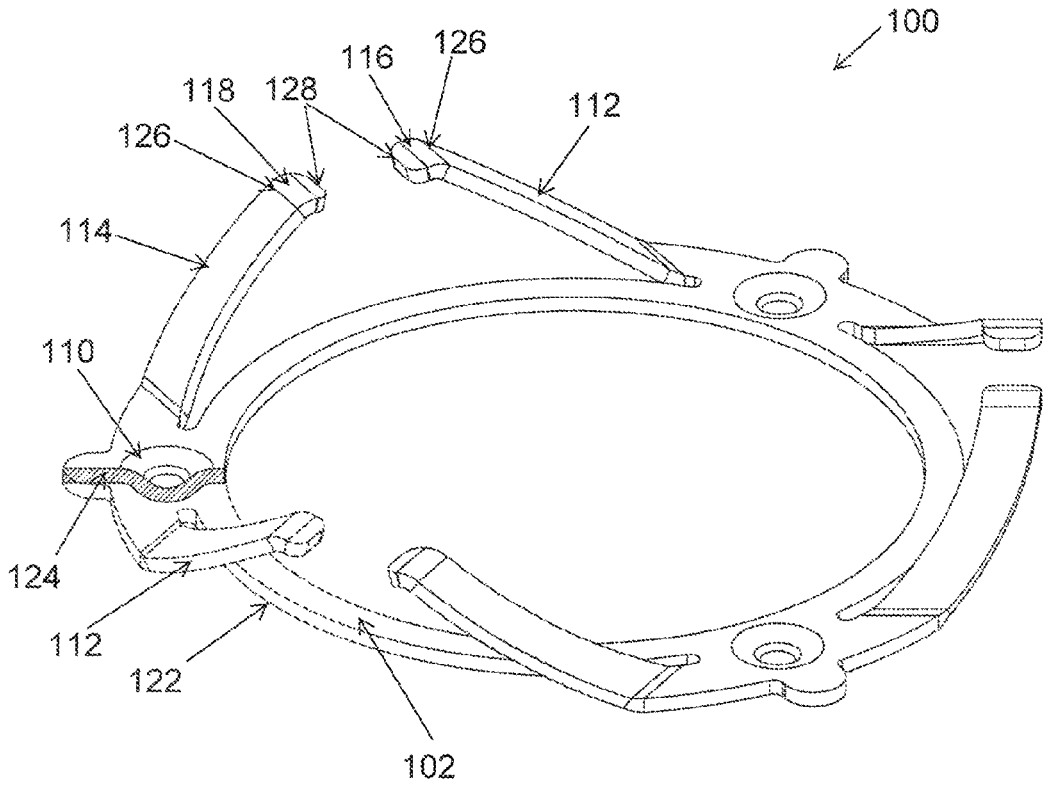
FIG. 1B illustrates a cross-section of a portion of the connector spring of FIG. 1A according to an example embodiment.

Turning now to the drawings, example embodiments are described. FIG. 1A illustrates a perspective view of a connector spring 100 according to an example embodiment. FIG. 1B illustrates a cross-section of a portion of the connector spring 100 according to an example embodiment. The connector spring 100 is an anti-decoupling spring. For example, the connector spring 100 can be used with an electrical connector as described with respect to FIGS. 2-4 or other connectors. As illustrated in FIG. 1A, the connector spring 100 includes a ring 102 and protruding segments 104, 106, 108. Each protruding segment 104, 106, 108 includes a first spring finger 112 and a second finger 114.

In some example embodiments, the ring 102 has a substantially circular shape. For example, the ring 102 may have an outer diameter of approximately 0.6 inches. The inner diameter of the ring 102 may be sized such that the ring 102 can fit around a cylindrical structure, such as a plug shell of an electrical connector. The ring 102 may also have a substantially flat wall between the outer and inner diameters as the wall extends in a substantially circular shape. To illustrate, the ring 102 may be cut out of a substantially flat metal sheet or plate (e.g., steel or aluminum sheet or plate) by cutting two concentric circles into the metal sheet or plate.

In some example embodiments, the ring 102 may have a thickness of approximately 0.005 inches corresponding to the thickness of the metal sheet or plate that is used to form the ring 102. Alternatively, in some embodiments, the ring 102 may be made from a metal sheet or plate that is approximately 0.010 or 0.015 inches thick. The ring 102 may also be made from metal sheet or plate that is thinner than 0.005 inches, thicker than 0.015 inches, and other thicknesses therebetween.

As illustrated in FIG. 1A, the protruding segments 104, 106, 108 protrude radially out from the ring 102. In some example embodiments, the protruding segments 104, 106, 108 may protrude radially inward from the ring 102. Each protruding segment 104, 106, 108 is positioned around the outer circumference of the ring 102. In some example embodiments, the protruding segments 104, 106, 108 are spaced approximately equally around the outer circumference of the ring 102. For example, as measured between corresponding centers of the protruding segments 104, 106, 108, the protruding segments 104, 106, 108 may be positioned approximately 120 degrees apart from each other around the outer circumference of the ring 102. In some example embodiments, the protruding segments 104, 106, 108 may not be equally spaced around the outer circumference of the ring 102.

The first spring finger 112 and the second spring finger 114 of each protruding segment 104, 106, 108 extend angularly away from each other. In some example embodiments, the first spring finger 112 of each protruding segment 104, 106, 108 extends out from a first edge of the respective protruding segment 104, 106, 108. The second spring finger 114 of each protruding segment 104, 106, 108 extends out from a second edge of the respective protruding segment 104, 106, 108. For example, the first edge and the second edge of each protruding segment 104, 106, 108 may be on opposite sides of the respective protruding segment 104, 106, 108 as illustrated in FIG. 1A. Alternatively, the first edge and the second edge of each protruding segment 104, 106, 108 may be on two sides of the respective protruding segment 104, 106, 108 that are not opposite sides.

The first spring finger 112 and the second spring finger 114 of each protruding segment 104, 106, 108 are compressible. The first spring finger 112 and the second spring finger 114 are elastic such that the first spring finger 112 and the second spring finger 114 return to substantially their respective uncompressed position upon removal of a respective compressing force. Because of the elastic characteristics of the first spring finger 112 and the second spring finger 114, the connector spring 100 can function as a system spring as well as a ratchet spring of an electrical connector by absorbing shock as well as by reducing decoupling of a coupling ring due to vibration.

In some example embodiments, the first spring finger 112 and the second spring finger 114 of each protruding segment 104, 106, 108 include a respective end portion. To illustrate, the first spring finger 112 and the second spring finger 114 of the protruding segment 104 include an end portion 116 and an end portion 118, respectively. The end portions 116, 118 may provide a contact surface for the first and second spring fingers 112, 114 when the first and second spring fingers 112, 114 are positioned against a structure such as a rear cover of an electrical connector. As more clearly illustrated in FIG. 1B, in some example embodiments, the direction of the spring finger 112 changes at an end break marker 126 such that the end portion 116 can have a surface that is in contact with a surface of another structure (e.g., a rear cover 208 shown in FIG. 2) when the end portion 116 is placed against the other structure.

Similarly, in some example embodiments, the direction of the spring finger 114 changes at an end break marker 126 such that the end portion 118 can have a surface that is in contact with a surface of another structure when the end portion 118 is placed against the other structure. Further, in some example embodiments, the end portions 116, 118 may each include an edge 128 that points slightly below the horizontal plane (in the orientation shown in FIG. 1B) for smoother rotation of the connector spring 100 when the end portions 116, 118 are in contact with a surface of a structure such as a rear cover of a plug shell. For example, in some example embodiments, the end portions 116, 118 may be curved between the respective end break marker 126 and the respective edge 128 such that the edges 128 do not come in direct contact with a surface of, for example, a rear cover of a connector when the end portions 116, 118 are pressed against the rear cover. In some example embodiments, the end portions 116, 118 may have shapes other than shown in FIGS. 1A and 1B such that the end portions 116, 118 do not make edge-to-surface contact with a structure (e.g., a rear cover) when pressed against the structure.

As illustrated in FIG. 1A, the connector spring 100 also includes dimples 110. Each dimple 110 may be positioned partially on a respective protruding segment 104, 106, 108 and partially on the ring 102. In some alternative embodiments, each dimple 110 may be positioned entirely on a respective protruding segment 104, 106, 108. In yet other alternative embodiments, each dimple 110 may be positioned entirely on the ring 102.

As illustrated in FIGS. 1A and 1B, relative to the ring 102, the dimples 110 protrude out in a direction that is opposite to the direction of the first and second spring fingers 112, 114. To illustrate, a cross-sectional surface 124 shown in FIG. 1B extends through the dimple 110. In the orientation of the connector spring 100 shown in FIG. 1B, a portion of the cross-sectional surface 124 that is at the dimple 100 is below a back edge 122 of the ring 102. The dimples 110 protrude out beyond the back surfaces of the protruding segments 104, 106, 108.

The dimples 110 illustrated in FIGS. 1A and 1B may be designed to fit into a respective depression of another structure. For example, the dimples 110 may serve as detents that provide resistance to a rotational movement of the connector spring 100 when the dimples 110 are positioned in respective depressions of a shoulder of a plug shell of an electrical connector, and particularly when a compression force is applied to the spring fingers 112 and 114. In some example embodiments, the dimples 110 are substantially dome-shaped as illustrated in FIG. 1A. For example, each dimple 110 illustrated in FIG. 1A may be formed by stamping a portion of the ring 102 and a portion of the respective protruding segment 104, 106, 108. In alternative embodiments, the dimples 110 may have other shapes, such as a dome shape.

Figure 2:
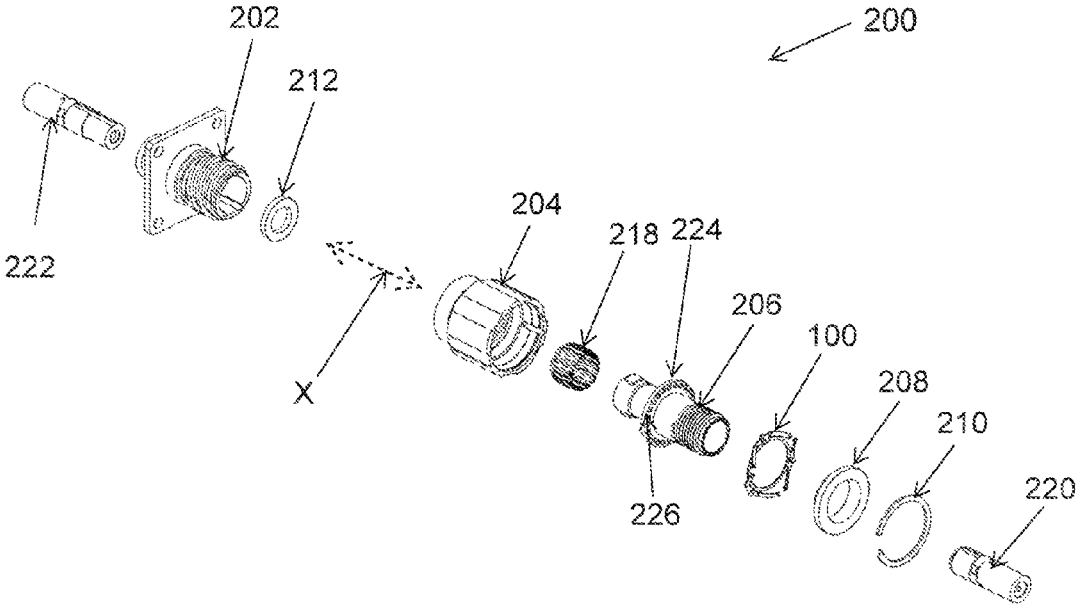
FIG. 2 illustrates an exploded view of a connector including the connector spring of FIG. 1 according to an example embodiment.
Figure 3:
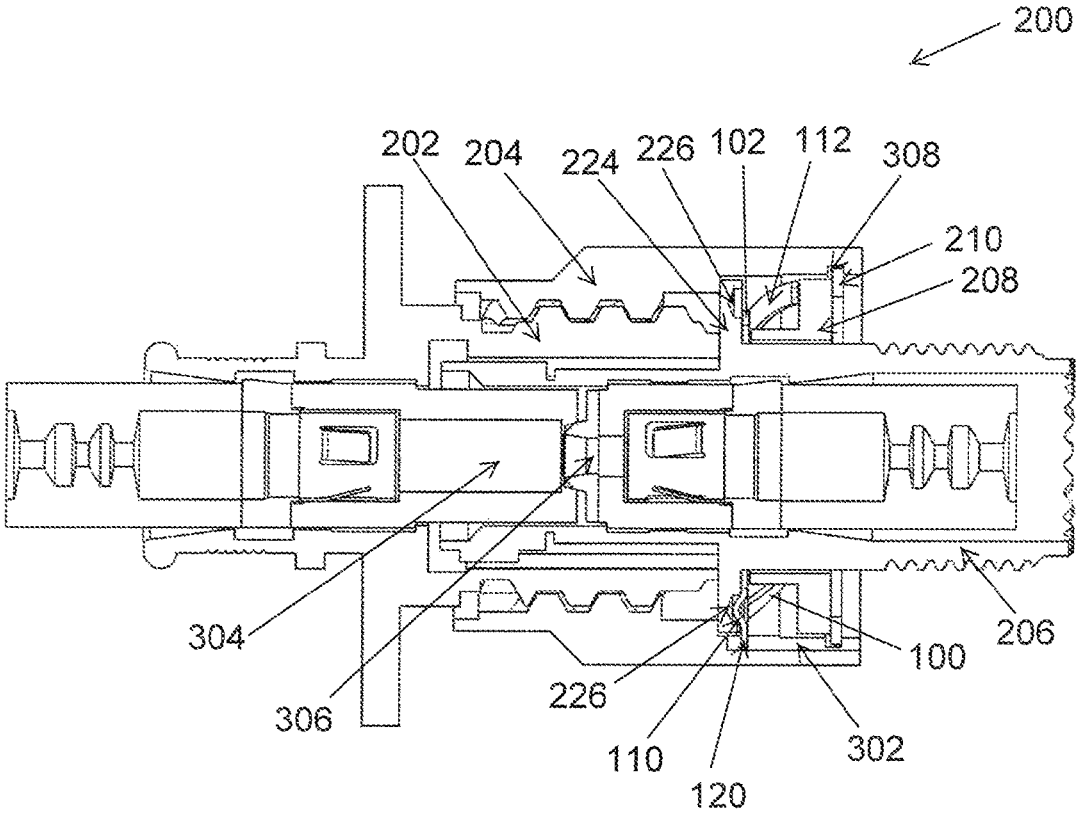
FIG. 3 illustrates a cross-sectional view of a connector including the connector spring of FIG. 1 according to another example embodiment.
Figure 4:
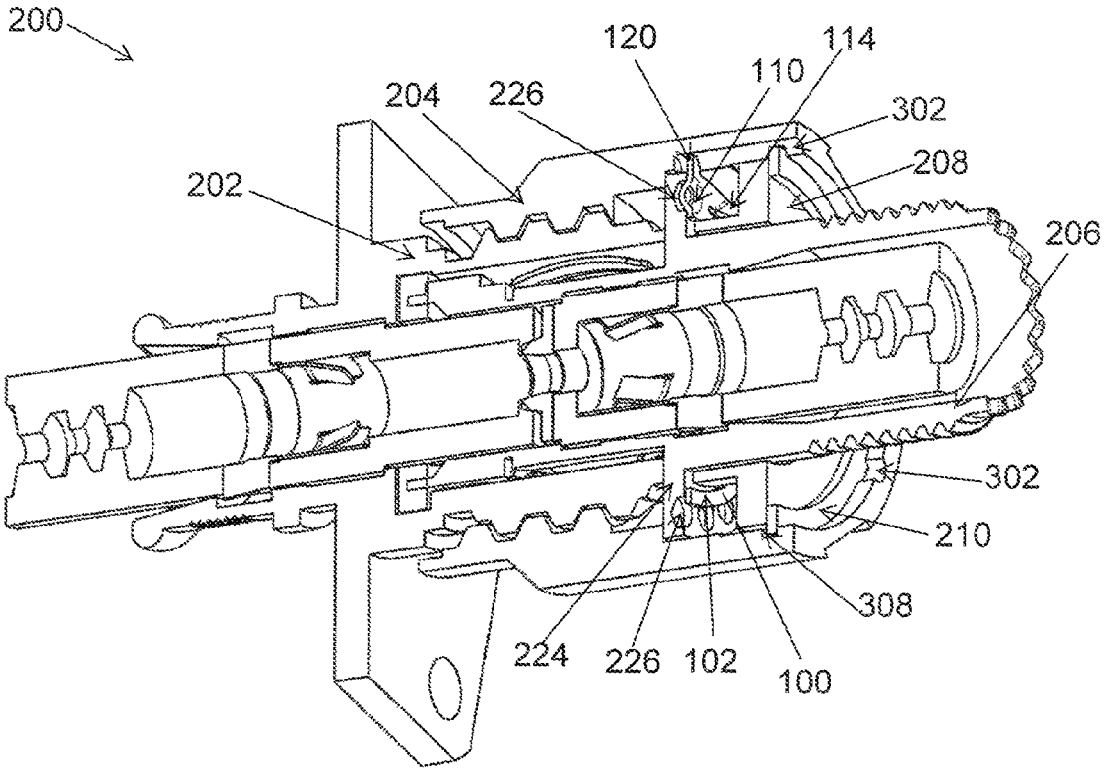
FIG. 4 illustrates a cross-sectional view of a connector including the connector spring of FIG. 1 according to an example embodiment.

In some example embodiments, the connector spring 100 includes keying tabs 120. Each keying tab 120 protrudes out from a respective one of the protruding segment 104, 106, 108. The keying tabs 120 are designed to fit into corresponding keyways/channels of, for example, a coupling ring of a connector, such as an electrical connector. An example embodiment of a coupling ring is shown in FIG. 2, and example embodiments of keyways formed on the inside of a coupling ring are shown in FIGS. 3 and 4. In some example embodiments, when the keying tabs 120 of the connector spring 100 are positioned in corresponding keyways of a coupling ring and the coupling ring is rotated around a receptacle shell, the connector spring 100 rotates along with the coupling ring. In some example embodiments, the number and/or shape of the keying tabs 120 may also be used to determine whether the connector spring 100 is compatible with a particular coupling ring.

In some example embodiments, the connector spring 100 may be formed by cutting the connector spring 100 out of a single metal sheet or plate, stamping the dimples 110 and bending to shape the spring fingers 112 and 114. Although three protruding segment 104, 106, 108 are shown in FIG. 1A, in alternative embodiments, the connector spring 100 may include fewer or more than three protruding segments. Also, some alternative embodiments, the connector spring 100 may have fewer or more than three dimples. Further, although the spring fingers 112 and 114 are each shown as a single finger in FIG. 1A, in alternative embodiments, each of the fingers 112 and 114 may be two or more fingers without departing from the scope of this disclosure. Further, although the dimples 110 are shown substantially equal distance between respective spring fingers 112, 114 of a particular protruding segment in FIG. 1A, in some alternative embodiments, the dimples 110 may be positioned closer to one of the spring fingers 112 or 114.

Because of the elastic characteristics of the first spring finger 112 and the second spring finger 114, the connector spring 100 can function as a system spring as well as a ratchet spring of an electrical connector by absorbing shock as well as by resisting decoupling of a coupling ring due to vibration. By combining the functions of a system spring, a ratchet spring, detents, and keying tabs into a single component, the connector spring 100 enables reduction of system cost by lowering component count.

FIG. 2 illustrates an exploded view of a connector 200 (e.g., an electrical connector) including the connector spring 100 of FIG. 1A according to an example embodiment. The connector 200 includes a receptacle shell 202, a coupling ring 204, a plug shell 206, and the connector spring 100. The coupling ring 204 is internally threaded, and the receptacle shell 202 is externally threaded. The coupling ring 204 is designed to be positioned around a portion of the receptacle shell 202 and a portion of the plug shell 206 such that the receptacle shell 202 and the plug shell 206 are coupled to each other by the coupling ring 204. The coupling ring 204 may move axially in the axial directions designated X in FIG. 2 as the coupling ring 204 is rotatably coupled and decoupled to the receptacle shell 202. In some example embodiments, the plug shell 206 has an annular shoulder 224 that extends around the plug shell 202. The shoulder 224 of the plug shell 206 may be positioned against an internal flange of the coupling ring 204 that extends around the inner circumference of the coupling ring 204. The shoulder 224 of the plug shell 206 may include depressions 226 that are designed to receive protrusions such as dimples 110 of the connector spring 100.

The connector 200 also includes a rear cover 208, a retaining ring 210, a plug insert assembly 220, and a receptacle insert assembly 222. The rear cover 208 is designed to be positioned around an outer circumference of the plug shell 206. In some example embodiments, the rear cover 208 is also intended to be positioned within and circumferentially surrounded by the coupling ring 204 such that the connector spring 100 is positioned around the plug shell 206 between rear cover 208 and the shoulder 224 of the plug shell 206.

In some example embodiments, the retaining ring 210 is designed to fit in an inner groove of the coupling ring 204 and to prevent the rear cover 208 from decoupling from the plug shell 206 as well as from moving outside of the coupling ring 204. In some alternative embodiments, the retaining ring 210 may be positioned in an outer groove of the plug shell 206 instead of the inside groove of the coupling ring 204.

In some example embodiments, the connector 200 also includes a peripheral seal 212, and a grounding spring 218. The peripheral seal 212 is designed to be positioned within the receptacle shell 202. The grounding ring 218 is designed to be positioned around a portion of the plug shell 206.

FIG. 3 illustrates a cross-sectional view of the connector 200 of FIG. 2 including the connector spring 100 of FIG. 1A according to another example embodiment. As illustrated in FIG. 2, a portion of the plug shell 206 is positioned within the receptacle shell 202 such that an electrical contact in a cavity 304 of the receptacle shell 202 is mated with a corresponding electrical contact in a cavity 306 of the plug shell 206. The coupling ring 204 is positioned around a portion of the receptacle shell 202. The outer threads of the portion of the receptacle shell 202 are mated with the inner threads of the coupling ring 204.

The rear cover 208 is positioned around the plug shell 206 and close to a rear opening of the coupling ring 204. The retaining ring 210 is positioned in an annular groove 308 that is formed in the inside of the coupling ring 204. The inner perimeter of the retaining ring 210 abuts against the rear cover and prevents the rear cover 208 from decoupling from the plug shell 206 as well as from moving outside of and beyond the rear opening of the coupling ring 204.

As illustrated in FIG. 3, the coupling ring 204 also includes keyways 302 that provide channels for the keying tabs 120 of the connector spring 100. To illustrate, the positions of the keyways 302 on the coupling ring 204 correspond to the positions of the keying tabs 120 on the protruding segments 104, 106, 108 of the connector spring 100 shown in FIG. 1A. For example, as illustrated in FIG. 3, the keying tab 120 of the connector spring 100 (at the bottom side of the connector spring 100 in the orientation shown in FIG. 3) is positioned in a keyway 302 of the coupling ring 204.

The connector spring 100 is positioned between the shoulder 224 of the plug shell 206 and the rear cover 208. The ring 102 of the connector spring 100 is positioned against the shoulder 224 of the plug shell 206. The fingers 112 and 114 of the connector spring 100 extend toward the rear cover 208. The fingers 112 are positioned between the rear cover 208 and the shoulder 224 of the plug shell 206 such that the end portions 116 of the spring fingers 112 are in contact with the rear cover 208. Similarly, the fingers 114 (shown in FIG. 1A) are positioned between the rear cover 208 and the shoulder 224 of the plug shell 206 such that the end portions 118 of the spring fingers 114 are in contact with the rear cover 208.

The dimples 110 of the connector spring 100 shown in FIG. 1A may be positioned in corresponding depressions 226 of the shoulder 224. As shown in FIG. 2, the depressions 226 are positioned around the surface of the shoulder 224 facing the rear cover 208. The depressions 226 may be shaped to correspond to the shape of the dimples 110 of the connector spring 100. In some example embodiments, the number of the depressions 226 may significantly exceed the number of dimples 110 of the connector spring 100. For example, the shoulder 224 may have twenty four depressions 226 that are spread equally apart on the shoulder 224. As shown in FIG. 3, the dimple 110 of the connector spring 100 (the dimple 100 at the bottom side of the connector spring 100 in the orientation shown in FIG. 3) is positioned in the depression 226 of the shoulder 224. In some example embodiments, each one of the three dimples 110 shown in FIGS. 1A and 1B may be positioned in corresponding depressions 226. Alternatively, fewer than the three dimples 110 shown in FIGS. 1A and 1B may be positioned respective depressions 226.

As the coupling ring 204 is tightened around the receptacle shell 202 by turning the coupling ring 204 in a coupling direction (i.e., a coupling rotational direction), the connector spring 100 rotates around the plug shell 206 because of the positioning of the keying tabs 120 in the keyways 302 of the coupling ring 204.

After the coupling ring 204 is tightened around the receptacle shell 202, the connector spring 100 functions as a system spring as well as a ratchet spring. The dimples 110 (shown in FIG. 1A) of the connector spring 100 serve as detents that resist rotation of the connector spring 100 in a decoupling direction, for example, due to vibration or other similar movements.

Because the compressed fingers 112 and 114 of the connector spring 100 exert a force on the rear cover 208, the rear cover 208 exerts a frictional force against a surface of the annular groove 308 of the coupling ring 204 via the retaining ring 210. In turn, the frictional force helps in preventing the coupling ring 204 from rotating in the decoupling direction due to vibration and/or other forces that may otherwise result in unintended decoupling of the coupling ring 204 from the receptacle shell 202. Further, once the coupling ring 204 is fully coupled to the receptacle shell 202, rotation of the decoupling the coupling ring 204 in a decoupling direction requires adequate force to dislodge each dimple 110 of the connector spring 100 from the respective depression 226 of the plug shell 206. Fully decoupling the coupling ring 204 from the receptacle shell 202 requires adequate force to dislodge the dimples 110 from the depressions 226 that are spread around the flange 224 multiple times. Thus, because the keying tabs 120 of the connector spring 100 are positioned within the keyways 302 formed in the coupling ring 204 and because the dimples 110 of the connector spring 100 resist rotation of the connector spring 100 in the decoupling direction, risk of unintended decoupling of the coupling ring 204 due to vibrations or other similar movements is reduced.

FIG. 4 illustrates a cross-sectional view of the connector 200 including the connector spring 100 of FIG. 1A according to an example embodiment. The connector 200 includes the receptacle shell 202, the coupling ring 204, and the plug shell 206. As illustrated in FIG. 4, a portion of the plug shell 206 is positioned within the receptacle shell 202. The coupling ring 204 is positioned around a portion of the receptacle shell 202. The coupling ring 204 is internally threaded, and the receptacle shell 202 is externally threaded. The coupling ring 104 is coupled to the receptacle shell 202 by turning the coupling ring 204 in a coupling direction (i.e., a coupling rotational direction) such that the outer threads of a portion of the receptacle shell 202 are mated with the inner threads of the coupling ring 204. The coupling ring 204 is also positioned around a portion of the plug shell 206 and securely attaches the plug shell 206 to the receptacle shell 202.

The rear cover 208 is positioned around the plug shell 206 and close to a rear opening of the coupling ring 204. The annular groove 308 formed on the inside surface of the coupling ring 204 allows positioning of the retaining ring 210 at the rear opening of the coupling ring 204. As described with respect to FIG. 3, the retaining ring 210, once positioned in the groove 308, is designed to prevent the rear cover 208 from decoupling from the plug shell 206 as well as from moving beyond the rear opening of the coupling ring 204.

The connector spring 100 is positioned between the shoulder 224 of the plug shell 206 and the rear cover 208. The ring 102 of the connector spring 100 is positioned against the shoulder 224 of the plug shell 206. The finger 114 of the connector spring 100 extends toward the rear cover 208. Similarly, the fingers 112 (shown in FIG. 3) extend toward the rear cover 208. The dimples 110 of the connector spring 100 are positioned in corresponding depressions 226 of the shoulder 224. For example, the dimple 110 (at the top side of the connector spring 100 in the orientation shown in FIG. 4) is positioned in the corresponding depression 226. The keying tab 120 (at the top side of the connector spring 100 in the orientation shown in FIG. 4) is also positioned in the corresponding keyway 302.

As described above, when the keying tabs 120 of the connector spring 100 are positioned in corresponding keyways 302 of the coupling ring 204 as shown in FIG. 4, the connector spring 100 turns along with the coupling ring 204 when the coupling ring 204 is rotated. After the coupling ring 204 is tightened around the receptacle shell 202 as illustrated in FIG. 4, the connector spring 100 functions as a system spring as well as a ratchet spring. As described above, the dimples 110 of the connector spring 100 serve as detents that resist unintended rotation of the connector spring 100 in a decoupling direction of the coupling ring 204 due to vibration or other similar movements. In turn, risk of unintended decoupling of the coupling ring 204 from the receptacle shell 202 is reduced.

Although particular embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A connector spring, comprising:

a ring;

a plurality of protruding segments protruding radially out from the ring, each protruding segment of the plurality of protruding segments comprising:

a first spring finger extending out from the protruding segment; and a second spring finger extending out from the protruding segment, wherein the first spring finger and the second spring finger angularly extend away from each other on a first side of the ring; and a plurality of dimples protruding out on a second side of the ring, wherein each dimple of the plurality of dimples is positioned at least partially on a respective protruding segment of the plurality of protruding segments.

2. The connector spring of claim 1, further comprising one or more keying tabs extending radially outward from the plurality of protruding segments and designed to fit into corresponding one or more keyways formed in a coupling ring of a connector.

3. The connector spring of claim 1, wherein each protruding segment of the plurality of protruding segments is positioned around the outer circumference of the ring.

4. The connector spring of claim 1, wherein the plurality of protruding segments are spaced approximately equally around an outer circumference of the ring.

5. The connector spring of claim 1, wherein each dimple of the plurality of dimples is substantially dome-shaped.

6. The connector spring of claim 1, wherein the plurality of protruding segments are three protruding segments.

7. The connector spring of claim 1, wherein the first spring finger of each protruding segment extends out from a first edge of the respective protruding segment and wherein the second spring finger of each protruding segment extends out from a second edge of the respective protruding segment, the first edge and the second edge being on opposite sides of the protruding segment.

8. The connector spring of claim 1, wherein the first finger and the second finger of each protruding segment of the plurality of protruding segments are compressible toward the second axial direction.

9. The connector spring of claim 1, wherein the first finger and the second finger of each protruding segment of the plurality of protruding segments include a respective end portion.

10. The connector spring of claim 1, wherein the ring is integrally formed with the plurality of protruding segments.

11. An electrical connector, comprising:

a plug shell having an annular shoulder comprising a plurality of depressions;

a coupling ring rotatably positioned around a portion of the plug shell; and a connector spring positioned around the plug shell between the plug shell and the coupling ring, the connector spring comprising:

a ring;

a plurality of protruding segments protruding radially out from the ring, each protruding segment of the plurality of protruding segments comprising:

a first spring finger extending out from a first edge of the protruding segment; and a second spring finger extending out from a second edge of the protruding segment, wherein the first spring finger and the second spring finger extend away from each other and from the annular shoulder; and a plurality of dimples extending out at least partially from the plurality of protruding segments, wherein each dimple of the plurality of dimples is positioned in a respective depression of the plurality of depressions.

12. The electrical connector of claim 11, further comprising a receptacle shell coupled to the coupling ring.

13. The electrical connector of claim 11, wherein the connector spring comprises one or more keying tabs protruding radially outward from the plurality of protruding segments and designed to fit into corresponding one or more keyways formed in the coupling ring.

14. The electrical connector of claim 11, wherein the plurality of protruding segments are spaced approximately equally around an outer circumference of the ring.

15. The electrical connector of claim 11, wherein each dimple of the plurality of dimples is positioned at least partially on a respective protruding segment of the plurality of protruding segments.

16. An electrical connector, comprising:

a receptacle shell;

a plug shell;

a coupling ring positioned around a portion of the plug shell and around a portion of the receptacle shell; and a connector spring positioned around the plug shell surrounded by the coupling ring, the connector spring comprising:

a ring;

a plurality of protruding segments protruding radially out from the ring, each protruding segment of the plurality of protruding segments comprising:

a first spring finger extending out from a first edge of the protruding segment; and a second spring finger extending out from a second edge of the protruding segment, wherein the first spring finger and the second spring finger extend angularly away from each other; and a plurality of dimples extending out at least partially from the plurality of protruding segments.

17. The electrical connector of claim 16, further comprising a rear cover positioned around the plug shell at an opening of the coupling ring, wherein the first spring finger and the second spring finger extend angularly toward the rear cover.

18. The electrical connector of claim 16, wherein each dimple of the plurality of dimples is positioned at least partially on a respective protruding segment of the plurality of protruding segments.

19. The electrical connector of claim 16, wherein the first finger and the second finger of each protruding segment of the plurality of protruding segments are compressible.

20. A connector spring, comprising:

a ring;

a plurality of protruding segments protruding radially out from the ring, each protruding segment of the plurality of protruding segments comprising:

a first spring finger extending out from the protruding segment; and a second spring finger extending out from the protruding segment, wherein the first spring finger and the second spring finger angularly extend away from each other on a first side of the ring; and a plurality of dimples protruding out on a second side of the ring; and one or more keying tabs extending radially outward from the plurality of protruding segments and designed to fit into corresponding one or more keyways formed in a coupling ring of a connector.

21. The connector spring of claim 20, wherein each protruding segment of the plurality of protruding segments is positioned around the outer circumference of the ring.

22. The connector spring of claim 20, wherein the plurality of protruding segments are spaced approximately equally around an outer circumference of the ring.

* * * * *